US005318602A

United States Patent [19]

Juch

[11] Patent Number: 5,318,602

[45] Date of Patent: Jun. 7, 1994

[54] FUEL GAS GENERATOR FOR LEAN GAS GENERATION

[76] Inventor: Helmut Juch, Haselweg 707, CH-4614 Hägendorf, Switzerland

[21] Appl. No.: 798,320

[22] Filed: Nov. 26, 1991

[51] Int. Cl.[5] ..... C10J 3/68

[52] U.S. Cl. ..... 48/76; 48/77; 48/117; 48/71; 110/229

[58] Field of Search ..... 48/117, 76, 63, 87, 48/77, 871, 111; 110/229

[56] References Cited

U.S. PATENT DOCUMENTS

| | | | |
|---|---|---|---|
| 4,306,506 | 12/1981 | Rotter | 48/76 |
| 4,309,195 | 1/1982 | Rotter | 48/77 |
| 4,344,772 | 8/1982 | Pillard | 48/77 |
| 4,389,222 | 6/1983 | Livemore | 48/76 |
| 4,919,686 | 4/1990 | Edwards | 48/111 |

*Primary Examiner*—James C. Housel
*Assistant Examiner*—Lien Tran
*Attorney, Agent, or Firm*—Pollock, Vande Sande & Priddy

[57] ABSTRACT

A fuel gas generator for lean gas generation by gasification of organic, inorganic, or fossil fuel substances. The triple shell structure of the generator includes a frame casing, a shaft jacket, and a reactor shaft. A fuel feeder including a fuel feed container is located substantially at the top of the reactor shaft and has a gas-tight entry lock. Reaction gas feed and ash discharge are located substantially at the base of the reactor shaft. Preheating, degassing, oxidation, and reduction zones and lean gas take-off orifices having at least one lean gas removal pipe connected thereto are arranged one after another in the shaft. The reactor shaft is gas-tight except for the lean gas take-off orifices. A firebox defined by a conical constriction is located in a middle region of the reactor shaft substantially below the preheating and degassing zones. The constriction tapers downwardly towards the base of the firebox retaining and supports a bed, pile, or stack of degassed and partially oxidized fuel substrate. A circular or annular opening, passage, or slot acts as a grate or grid element located at the base of the constriction at the termination of the reduction zone and as an upper terminus of a gas-tight ash chamber. At least one lean gas take-off orifice is located in the reactor shaft below the grid element.

17 Claims, 2 Drawing Sheets

FUEL GAS GENERATOR FOR LEAN GAS GENERATION

FIELD OF THE INVENTION

The invention relates to a fuel gas generator for lean gas generation by means of gasification of organic solids in the form of pieces. In particular, the present invention relates to a fuel gas generator for the gasification of fossil fuels or inorganic substances in a reactor shaft having a fuel feed organ and having a reaction air feed in the shaft head. Arranged between this air feed and an ash discharge are a preheating zone, a degassing zone, an oxidation zone, a reduction zone, and lean gas take-off orifices arranged in the region thereof and having at least one lean gas removal pipe connected thereto.

BACKGROUND OF THE INVENTION

Between the main generator/gasifier systems, the generally preferred countercurrent gasifier and the cocurrent gasifier, the latter is preferred according to the invention for generating the lean gas. The generator gas obtained according to the principle of countercurrent gasification is of limited use since it can be used only for subsequent direct combustion because it has a high content of viscous pyrolysis products, such as tar, phenol and the like, which condense at temperatures below 400° C.

The principle which is preferred according to the basic concept of the invention involves descending gasification, in which the dry zone and the pyrolysis zone are formed in the upper part of the reactor. According to preferred aspects of the present invention, in contrast to the countercurrent principle, air is fed in from above, directly after the pyrolysis zone. The combustion produces the necessary temperatures to cleave the descending low-temperature carbonization products from the pyrolysis zone into readily combustible gases. The remaining volatile substances are also gasified from the charcoal. Thus, no tar products enter the subsequent reduction zone.

Regarding the technological peculiarities of these gasification processes, reference is made to "Holzvergasung", Willy Bierter/Christian Gaegauf, Karlsruhe, 1982, page 52 et seq. Furthermore, the prior art in the area of gas generators includes German Patent 3,239,624, FIG. 1 to 3 and associated description, column 2, line 11 et seq and column 4, lines 41 to 7, page 10.

The stated patent describes five gasification principles, among which the cocurrent principle is most closely related to the invention. In order to carry out this gasification principle, the invention provides a generator whose elements and features have, in some cases been radically redesigned and in some cases, modified compared with the prior art, so that the generator process is based on a modified cocurrent principle.

SUMMARY OF THE INVENTION

Starting from the fuel gas generator described at the outset and arising from the stated prior art, the embodiment according to the invention comprises a) an embodiment of the reactor shaft which is gas-tight except for the lean gas take-off orifices and has a highly refractory lining, b) a gas-tight entry lock for fuel feed, c) in the middle region of the reactor shaft, a constriction, tapering conically toward a firebox, about two thirds to one fourth of the internal diameter of the shaft, for retaining the wood charcoal layer formed by degassing and undergoing combustion by slow oxidation, d) a circular or annular grid element which terminates the subsequent reduction zone at the bottom and terminates an ash chamber at the top, e) at least one lean gas take-off orifice in the region of the reactor shaft below the grid element, f) an ash space lock arranged below the gas-tight ash chamber, for periodic opening of a passage to a space for ash removal, and g) an ash collecting and removal apparatus provided below the ash space lock.

The fuel gas generator having the above constructional features permits continuous gas generation. The previously comminuted fuel, for example wood, is introduced into the entry lock via a feed. The upper gate of the lock is opened and the lower one closed. This operation is terminated by the level control of the feed chamber of the lock after the set level has been reached. Thereafter, the upper gate closes the entry lock. If the level in the preheating zone falls below the set height, another feed operation is initiated by the level control. The purpose of the fire in the reactor shaft constriction, which is also designated the firebox, is to form a charcoal layer. This combustion produces the necessary temperature for cleaving the descending low-temperature carbonization products from the pyrolysis zone into readily combustible gases. The central feed of the combustion air ensures that the temperature required for cleavage of the gases is maintained in the constriction.

The reduction zone is closed at the bottom by a novel embodiment of the firebox. An annular grid element is created by means of the counter-cone entering the region of the firebox from below. An annular passage for the ash, whose cross-section is variable, is formed.

The ash obtained in various small amounts is collected in the ash space and transported away. Some of this ash can be mixed with the loam as a porosity agent for brick production.

An important special feature of the fuel gas generator according to the invention is the design of the firebox, which also acts as a grid element. The firebox is formed from a conical constriction tapering from top to bottom and another conical constriction connected thereto and tapering from bottom to top. According to an additional feature, a counter-cone can be inserted concentrically to a greater or lesser height into the conical firebox constriction tapering from bottom to top. An annular passage forming the grid element and having a variable cross-section can thus be produced. It is intended that the counter-current cone be arranged on the upper end of the lifting rod, guided centrally in the reactor shaft, equipped with a lift drive, and be rotatable and have its lifting rod additionally equipped with a rotary drive.

As a result of this embodiment, it is possible to adapt the grid element formed by the firebox to the characteristics and particle size of the material used. It is also possible to influence the course of the process. The annular passage between the cone and the conical surface of the firebox is altered by means of the adjustable counter-cone, with the result that the throughput rate can also be controlled.

Another essential of the present invention is the gas-tight entry lock. The entry lock consists of two flat or rotary gates which are arranged in the shaft head above and below a feed container. The entry lock closes off the feed container at the bottom from the reactor shaft and at the top from an upstream fuel conveying apparatus. Also the entry lock can be opened or closed on alternate sides. Further, the gates may be in their guides. In conjunction with the ash space lock, which is likewise gas-tight and is functionally designed in the same way as the entry lock, it is found that the total reactor shaft, except for the region of the take-off of the lean gas generated, is absolutely gas-tight.

In order to permit an optimum process adapted to the particular starting material, the gas generator according to the invention is equipped with a number of measuring, display and control apparatuses.

The supply and feeding of the generator with starting material must be controlled according to the progress of the process. For this purpose, at least one level measuring and indicating apparatus is arranged in the feed chamber and in the region of the preheating zone in the reactor shaft. By means of the measuring and indicating apparatus and via a regulating apparatus, the delivery of the feed apparatus can be influenced and the entry lock can be controlled. It is also possible for two or more level measuring and indicating apparatuses to be arranged, especially in the reactor shaft, for monitoring the level, in order to determine the upper and lower level limit. By means of these measuring apparatuses, the periodic feeding the amount fed in each case, and the required functions of a feed conveyor and of the gates of the entry lock can be remote controlled.

Moreover, according to further aspects of the present invention, thermocouples for temperature monitoring in the preheating zone, degassing zone and oxidation zone are arranged above and in the region of the firebox. Also, the amount of air fed in to the generator can be influenced by changing the cross-section of the air orifices on the basis of the thermocouple measurement. Furthermore, it is also possible to ensure that the fan suction power in the lean gas removal pipe can be influenced on the basis of the thermocouple measurements. In addition, it is also possible to design the controls so that the oxygen content of the reaction air feed can be influenced as a function of the starting material used and the desired course of the process using the thermocouple measurements.

The design of this gas generator as a whole ensures that it has a wide range of applications and uses in a previously unknown manner. It is possible to use a very wide range of organic, fossil or inorganic materials having a wide range of particle sizes in order to produce a lean gas of very good calorific value. The essential feature in this generator concept is that the combustion of the lean gas generated is particularly environmentally friendly. Measurements by a recognized institute for environmental analysis have shown that the waste gas has the following measured values:

Gas chromatographic measurements:

| | |
|---|---|
| Oxygen | 15.5% by volume |
| Nitrogen | 78.3% by volume |
| Methane | <0.03% by volume |
| Carbon dioxide | 6.2% by volume |
| Hydrogen | <0.01% by volume |

These average values were obtained during normal operation, about two hours after ignition of the generator. A further measurement obtained was the following:

Formaldehyde concentration <0.01% by volume

These waste gas values make it possible to remain below the limits of the clean air regulations.

According to the further aspects of the present invention, the constructional features of the fuel gas generator are also very important in that the shaft jacket of the generator, together with the gas-tight generator shaft and the material feed apparatuses, is arranged suspended in a frame which consists of frame posts and frame crossbars connecting them. It is envisaged that the generator shaft jacket is attached to the frame crossbars by means of flexible holders. Furthermore the frame, consisting of the frame posts and the frame crossbars, is completely surrounded by a frame casing. Only the air orifices in the region of the foundation serving for air inlet.

The embodiment in which an annular space between the frame casing and the shaft jacket serves for feeding in reaction air and is connected to the riser pipe and the air inlet pipe is particularly advantageous. This design ensures that the reaction air sucked in passes along the hot shaft jacket and is thus heated. A further advantageous thermal effect arises by providing a vertical gas-tight cylindrical cavity between the shaft jacket and the upper and lower part of the reactor shaft. The lean gas emerging at the lower end of the reactor shaft passes upward through the cavity and enters the lean gas collecting pipe connected to the cavity. As a result of this arrangement and embodiment, the lean gas emerging downward in the region of the upper edge of the reactor shaft passes upward in the cylindrical cavity and, in the upper region of the reactor shaft, in the region of the preheating zone, releases some of its heat to the reactor shaft wall, thereby improving the preheating and being cooled at the same time cooled.

As a result of these structural measures, the thermal efficiency is improved and, hence, not only is the heat balance improved, but there is also better carbonization and degassing of the starting material. As a result a lean gas having a higher energy content with a small amount of residue is produced.

Further features and advantages of the invention are evident from the embodiment shown in the drawings and described in detail below.

BRIEF DESCRIPTION OF THE PREFERRED EMBODIMENTS

Figure 1:
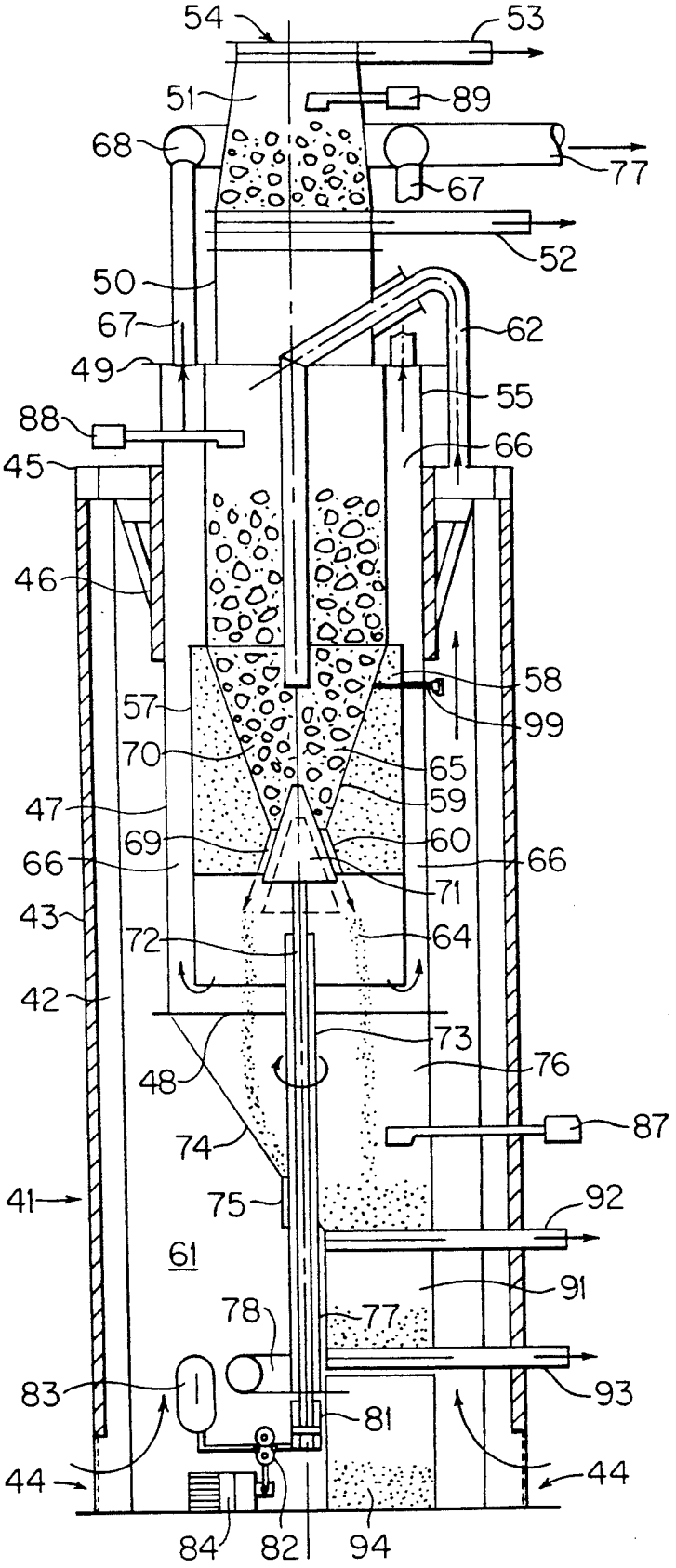
FIG. 1 shows a vertical longitudinal section through the fuel gas generator of the present invention.
Figure 2:
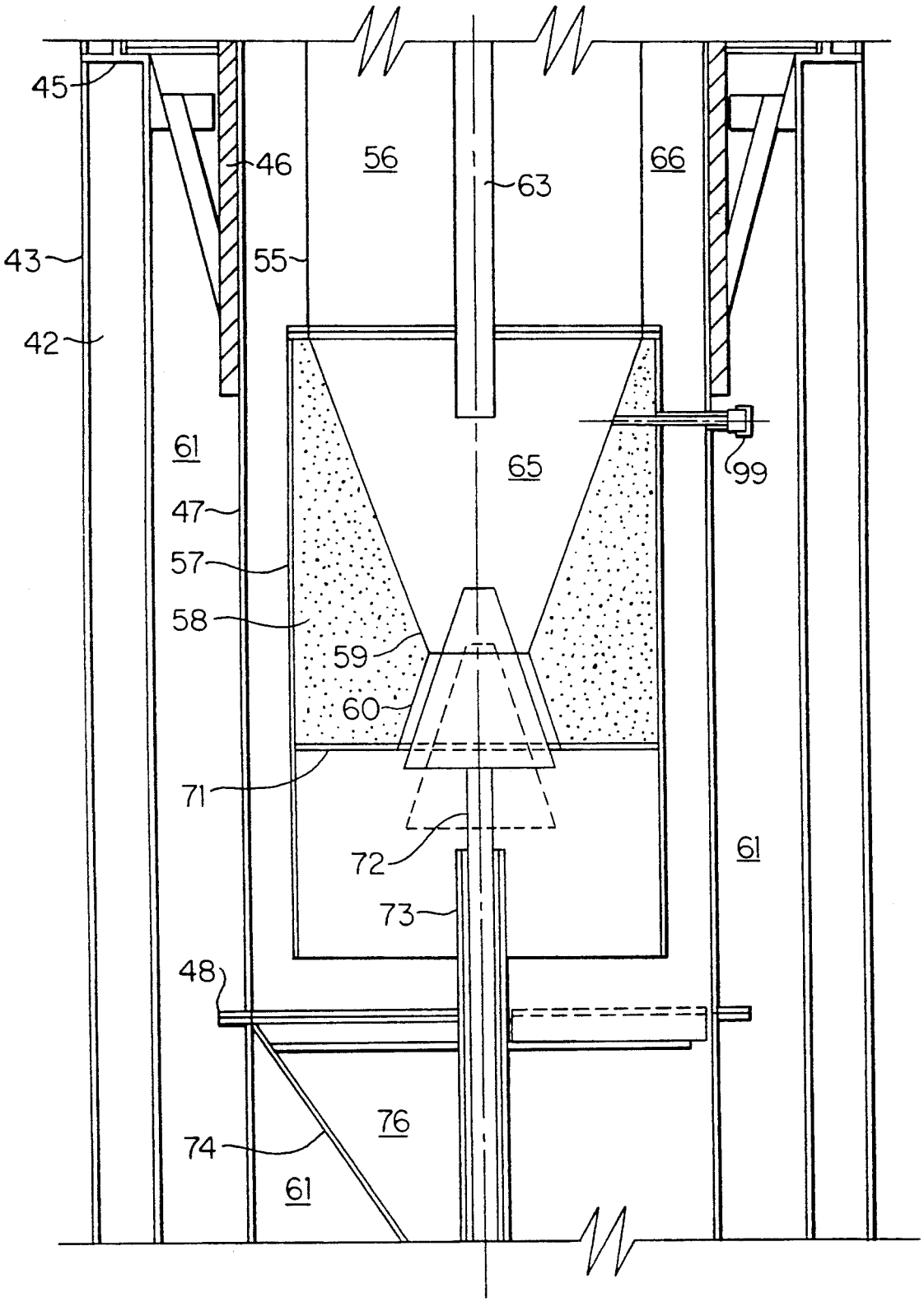
FIG. 2 shows a partial section of the embodiment shown in FIG. 1.

The fuel gas generator 41 according to the invention is designed as a gas generator and is arranged suspended in a frame. The frame in the embodiment shown in FIG. 1, consists of four frame posts 42 which are connected to one another at their upper end by frame crossbars 45. A holder 46, in which the cylindrical shaft jacket 47 of the gas generator is fastened, is mounted on the frame crossbars 45. The larger part of the shaft jacket hangs downward in frame 42 while a shorter piece of the shaft jacket projects upward above the frame crossbars 45. This arrangement ensures that the shaft jacket can move freely upward and downward.

The shaft jacket 47 is closed at the bottom by a baseplate 48 and at the top by a top plate 49, both of which are annular.

The shaft head 50, which is closed at the top by a gas-tight entry lock, is mounted on the upper baseplate 49. The entry lock consists of flat gates 52, 53 arranged one below and one above a feed chamber 51; the gates are sealed in their guides. A feed 54, which is not described in detail, is provided above the upper flat gate 53. The material falls into the feed chamber 51 when the upper flat gate 53 is opened. The chamber is equipped with a level measuring and indicating apparatus 89. The feed 54 can thus be influenced via a regulating apparatus, which is not shown, and the entry lock can be controlled. After the upper flat gate 53 has been closed, the lower flat gate 52 is opened and the material falls into the generator shaft 55, 57 located underneath. The upper shaft part 55 is suspended from the upper top plate 49 and provided with an inner lining and serves as a preheating and degassing zone 56 for the material introduced. A level measuring apparatus 88, which may also be combined with a temperature sensor, is arranged in the region of this zone. The course of the process, in particular the throughout rate and also the process temperature, can thus be monitored and, if necessary, influenced.

A lower shaft part 57, which is equipped with a highly refractory lining 58 and has a firebox 65, follows under the preheating and degassing zone. The firebox is formed from a conical constriction 59 tapering from top to bottom and a conical constriction 60 connected thereto and tapering from bottom to top. The oxidation zone and reduction zone 70 are formed in this region.

A cylindrical cavity 66, which extends from the lower shaft part 57 to the top plate 49, is present between the shaft jacket 47 and the upper and lower shaft parts 55 and 57 of small external diameter. In this cavity 66, the lean gas is produced and passes downward at 64. The gas then passes upward and heats the material present in the preheating zone 56, after which it passes through the lean gas collecting pipe 67 and the ring pipe 68 into the lean gas removal pipe 77.

The reaction air or inert gas is fed into the reactor shaft 55, 57 through an air inlet pipe 63. The air inlet pipe centrally and vertically along the vertical axis A of the reactor 41, extends downward into the initial region of the firebox 65 and is connected to the riser pipe 62. The reaction air is sucked in in the region of the orifices 44 which are left open in the foundation region of the frame casing 43 surrounding the frame posts 42. An annular space 61, through which the air sucked in rises upward, is heated and enters the riser pipe 62, is provided between this casing 43 and cylindrical shaft jacket 47.

The means comprising the counter-cone 71 which can be pushed into the firebox 65 from below and rests concentrically with respect to the vertical axis A in the upper end of a lifting rod 72 which can be raised and lowered in a sealed vertical guide 73, is essential for carrying out the process in the generator. The lower part of the vertical guide 73 is in the form of a hydraulic lifting cylinder, in a manner not described. The hydraulic drive consists of the motor 84, the hydraulic pump 82 and the equilibration vessel 83. A rotary drive having a motor 78 is arranged so that it acts directly on the lifting rod 72.

The counter-cone 71 can be adjusted so that the passage 69, in the form of a conical ring, becomes larger or smaller. The combination of the firebox 65 and counter-cone 71 acts as an adjustable grid element which can be adapted to the characteristics, in particular the particle size of the material used. The ash parts fall through the passage 69 and enter the ash chamber 76 above the ash space lock 91, 92, 93. In the chamber, the ash parts collect on the upper flat gate 92. The ash chamber 76 has an inclined surface 74 through which the vertical guide 73 of the lifting rod 72 passes and which is sealed from the latter by means of a gland 75. Furthermore, this inclined surface is sufficiently steep and coated in such a way that no bridging with ash can occur.

The ash space lock consists of the upper ash space flat gate 92 and the lower ash space flat gate 93. Between the gates the ash space 91 can be sealed air-tight above and below. The ash is periodically emptied,—as in the case of the material feed. An amount of ash is always being discharged from the ash chamber 76 into the ash space 91. From the ash space by opening and closing the lower ash space flat gate 93, the ash moves into the collecting and transport container 94.

A sensor 87, which reports a certain level of ash and initiates the ejection of this amount of ash through the lock, is arranged in the ash chamber. After a relatively large amount of ash has been ejected through the lock and collected in the transport container 94, the latter is removed and is replaced by an empty container.

I claim:

1. A fuel gas generator for lean gas generation by means of gasification of solid pieces of organic, inorganic, or fossil fuel substances, said generator comprising:

a reactor shaft;

a fuel feed means including a fuel feed container located substantially at the top of said reactor shaft, said fuel feed means having a gas-tight entry lock;

a reaction gas feed means and an ash discharge means located substantially at the base of said reactor shaft;

a preheating zone, a degassing zone, an oxidation zone, a reduction zone, and lean gas take-off orifices having at least one lean gas removal pipe connected thereto, said zones being arranged one after another in said shaft between said fuel feed means and said ash discharge means;

said reactor shaft being gas-tight with the exception of said lean gas take-off orifices;

a firebox defined by a conical constriction located in a middle region of said reactor shaft substantially below said preheating zone and said degassing zone, said constriction tapering downwardly and inwardly towards the base of said firebox, said constriction retaining and supporting a mass of degassed and partially oxidized fuel substrate;

a circular or annular grid element located at the base of said constriction at the termination of said reduction zone, said grid element acting as an upper terminus of a gas-tight ash chamber;

said at least one lean gas take-off orifice located in the reactor shaft below said grid element;

an ash space lock located below said gas-tight ash chamber, for periodically opening a passage to an ash space for ash removal;

an ash collecting and removal apparatus located below said ash space lock;

said grid element is variable in cross-sectional area;

said firebox being formed from said first downwardly and inwardly conically tapering constriction to a mid-portion thereof and a second upwardly and inwardly tapering conical constriction to said mid-portion thereof.

2. The fuel gas generator according to claim 1, wherein said grid element, comprising an annular passage having a variable cross section, is formed by the concentric insertion of a counter cone into said second constriction of said firebox, said grid element varying in cross-sectional area with the insertion of said counter cone to a varying height by means for inserting and supporting said counter cone.

3. The fuel gas generator according to claim 2, wherein means for inserting and supporting includes a lifting rod, said counter cone being attached to an upper end of said lifting rod, said lifting rod being centrally guided in said reactor shaft and including means for lifting said counter cone.

4. The fuel gas generator according to claim 3, wherein said counter cone is rotatable and said lifting rod also includes means for rotating said counter cone.

5. The fuel gas generator according to claim 4, wherein said lifting means includes a lift drive and said rotating means includes a rotor drive.

6. The fuel gas generator according to claim 1, wherein thermocouples for temperature monitoring are located in said preheating, degassing and oxidation zones both above and in the region of said firebox; and a gas flow through said reaction gas feed means can be altered by changing a cross-section of said gas orifices in said reaction gas feed means based upon measurements from said thermocouples.

7. The fuel gas generator according to claim 6, wherein a fan is located in said at least one lean gas removal pipe, a suction power of said fan being influenced based upon measurements from said thermocouples.

8. The fuel gas generator according to claim 6, wherein an oxygen content of said reaction gas can be influenced based upon measurements from said thermocouples.

9. The fuel gas generator according to claim 6, wherein said generator includes a shaft jacket which together with said gas-tight reactor shaft and said fuel feed means is suspended in a frame which consists of frame posts and frame crossbars connecting them; said generator shaft jacket is attached to said frame crossbars by means of flexible holders.

10. The fuel gas generator according to claim 9, wherein said frame is surrounded by a frame casing and wherein said gas orifices of said reaction gas feed means are located in the region of a foundation of said frame and serve as the only gas inlet to said gas generator.

11. The fuel gas generator according to claim 10, wherein an annular space between said frame casing and said shaft jacket serves for feeding in reaction gas into said gas generator and is connected to a riser pipe and an air inlet pipe.

12. The fuel gas generator according to claim 9, wherein a vertical gas-tight cylindrical cavity is located between said shaft jacket and an upper and lower part of said reactor shaft, wherein said lean gas emerges at the lower end of said reactor shaft and passes upward through said cylindrical cavity and enters the lean gas collecting pipe connected to the cavity.

13. The fuel gas generator according to claim 6, wherein said gas-tight ash chamber is suspended below a lower reactor shaft part and provides a gas-tight seal at the top and bottom of said ash space; said ash space lock being formed from flat or rotary gates being arranged below said ash chamber.

14. The fuel gas generator according to claim 1, wherein said constrictions taper to about between two-thirds and one-fourth of the internal diameter of said reactor shaft.

15. The fuel gas generator according to claim 1, wherein said reaction gas is an inert gas or a mixture of air and inert gas.

16. The fuel gas generator according to claim 1, wherein said gas-tight entry lock includes two flat slide gates, said gates being mounted in guides located in said shaft both above and below said fuel feed container, said gates closing said fuel feed container at the bottom from said reactor shaft and at the top from an upstream fuel conveying apparatus, said gates being alternately opened or closed.

17. The fuel gas generator according to claim 1, wherein said reaction gas feed means is an air inlet pipe which runs centrally along a vertical axis of said reactor and at least partially extends into said firebox.

* * * * *